US009214302B2

(12) United States Patent
Mattlar et al.

(10) Patent No.: US 9,214,302 B2
(45) Date of Patent: Dec. 15, 2015

(54) ELECTRIC CURRENT SWITCHING APPARATUS

(71) Applicant: ABB Oy, Helsinki (FI)

(72) Inventors: Harri Mattlar, Iskmo (FI); Mikko Välivainio, Vaasa (FI)

(73) Assignee: ABB OY, Helsinki (FI)

( * ) Notice: Subject to any disclaimer, the term of this patent is extended or adjusted under 35 U.S.C. 154(b) by 267 days.

(21) Appl. No.: 13/915,202

(22) Filed: Jun. 11, 2013

(65) Prior Publication Data

US 2013/0327618 A1 Dec. 12, 2013

(30) Foreign Application Priority Data

Jun. 11, 2012 (EP) ..... 12171421

(51) Int. Cl.

| | |
|---|---|
| ***H01H 9/00*** | (2006.01) |
| ***H01H 19/36*** | (2006.01) |
| ***H01H 9/16*** | (2006.01) |
| ***H01H 73/04*** | (2006.01) |
| *H01H 71/04* | (2006.01) |
| *H01H 1/20* | (2006.01) |
| *H01H 9/02* | (2006.01) |

(52) U.S. Cl.

CPC ..... *H01H 19/36* (2013.01); *H01H 9/16* (2013.01); *H01H 71/04* (2013.01); *H01H 73/045* (2013.01); *H01H 1/2041* (2013.01); *H01H 1/2058* (2013.01); *H01H 2009/0292* (2013.01); *H01H 2071/042* (2013.01); *H01H 2071/046* (2013.01)

(58) Field of Classification Search

CPC ..... H01H 19/36; H01H 71/04; H01H 9/16; H01H 73/045; H01H 73/12; H01H 1/2058; H01H 2071/046; H01H 1/2041; H01H 2009/0292; H01H 2071/042

USPC ..... 200/50.26, 308

See application file for complete search history.

(56) References Cited

U.S. PATENT DOCUMENTS

| | | | | | |
|---|---|---|---|---|---|
| 2,811,618 | A | * | 10/1957 | Cole et al. | 200/293 |
| 2,956,135 | A | * | 10/1960 | Feil | 337/43 |
| 4,796,154 | A | * | 1/1989 | Morris et al. | 361/634 |
| 5,477,016 | A | | 12/1995 | Baginski et al. | |

FOREIGN PATENT DOCUMENTS

| | | |
|---|---|---|
| DE | 101 15 427 C1 | 2/2002 |
| EP | 1 703 533 A2 | 9/2006 |

OTHER PUBLICATIONS

European Search Report issued on Nov. 29, 2012.

* cited by examiner

*Primary Examiner* — Renee Luebke
*Assistant Examiner* — Lheiren Mae A Caroc
(74) *Attorney, Agent, or Firm* — Buchanan Ingersoll & Rooney

(57) ABSTRACT

A rotary switch module includes a first stationary contact, a second stationary contact, and a movable contact for making an electrical connection between the first stationary contact and the second stationary contact. A rotary actuator is provided for rotating the movable contact, the rotary actuator having on its surface a first indication indicating an open position of the switch, and a second indication indicating a closed position of the switch. A first window indicates the first indication, and a second window separate from the first window indicates the second indication.

20 Claims, 10 Drawing Sheets

ELECTRIC CURRENT SWITCHING APPARATUS

RELATED APPLICATION

This application claims priority under 35 U.S.C. §119 to European Patent Application No. 12171421.6 filed in Europe on Jun. 11, 2012, the entire content of which is hereby incorporated by reference in its entirety.

FIELD

The present disclosure relates to an electric current switching apparatus.

BACKGROUND

Many issues affect designing of an electric current switching apparatus. The design goals include, for instance, ease of assembly of the switch, possibility to assemble various switch types, security of use of the switch, fast connecting and disconnecting of the contacts and efficient quenching of an arc firing when the contacts are separated.

SUMMARY

A rotary switch module is disclosed, comprising: a first stationary contact; a second stationary contact; a movable contact for making an electrical connection between the first stationary contact and the second stationary contact; a rotary actuator for rotating the movable contact, wherein the rotary actuator includes on a surface a first indication indicating an open position of the first and second stationary contacts, and a second indication indicating a closed position of the first and second stationary contacts; a first window indicating the first indication; and a second window separate from the first window indicating the second indication.

BRIEF DESCRIPTION OF THE DRAWINGS

In the following, the invention will be described in greater detail by way of preferred exemplary embodiments with reference to the accompanying drawings, in which.

DETAILED DESCRIPTION

Exemplary embodiments of the present disclosure can provide an improved electric current switch.

Electric switches can include a few switch modules/poles, which are stacked together to build multi-pole switches. Each module may comprise an insulating housing, which houses the electrical components of the switch modules. Each module housing may comprise a first housing half and a second housing half made of plastic, for instance, to be assembled together to form a switch module. The housing modules may be substantially rectangular.

Figure 1:
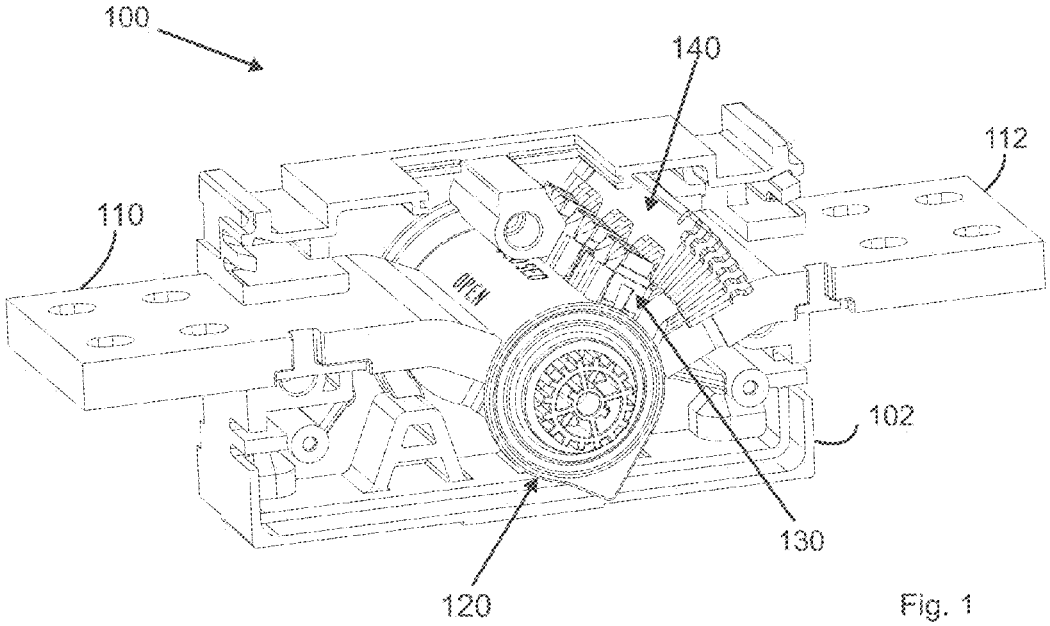
FIG. 1 shows an exemplary embodiment of a switch module.

FIG. 1 shows an exemplary embodiment of an electric switch module showing the first housing 102 equipped with the components of the module. The second housing of the switch module to be assembled against the first housing 102 for forming the module and covering the switch components is not shown.

FIG. 1 shows two stationary contacts 110, 112 at the opposite ends of the module and movable contacts 130 that are to be moved between open and closed positions of the switch. To perform the rotary action of the movable contacts 130, the device can include a rotary actuator 120.

The switch may also comprise a quenching chamber housing one or more quenching plates 140 used for quenching an arc that fires between the contacts when the movable contact is disconnected from the stationary contact(s).

Figure 2:
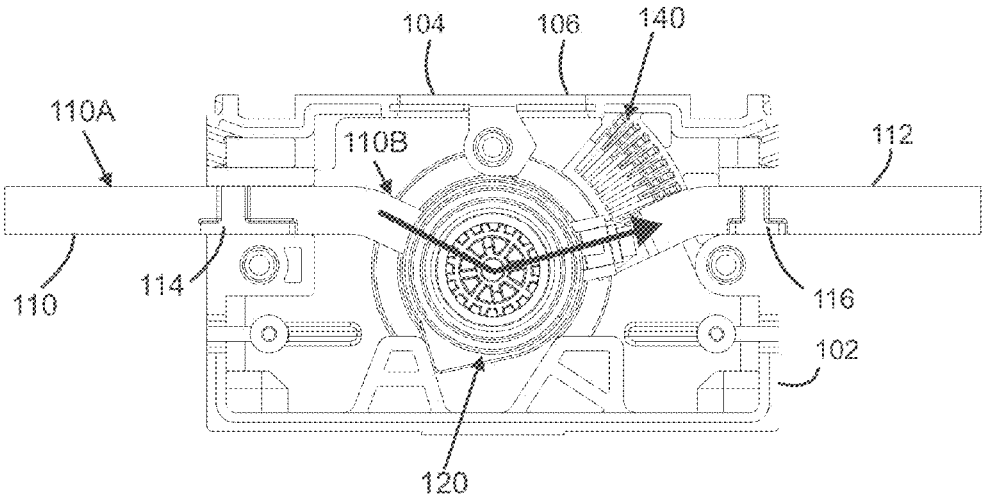
FIG. 2 shows another view of the exemplary switch module.

FIG. 2 shows the switch module of FIG. 1, however in a different rotary position than in FIG. 1. In FIG. 1, the switch is in open position in which the movable contacts 130 are separated from the stationary contact 112. In FIG. 2, the switch is in closed position, where the movable contact 130 is in contact with the stationary contact 112.

The stationary contact 110 comprises a connection portion 110A to be connected to an external conductor. The connection portion 110A is for example arranged substantially perpendicularly to the wall of the housing 102. The stationary contact can further comprise a contact portion 110B to be connected to the movable contact. It can be seen that the connection portion 110A and the contact portion 110B are, for example, arranged to an angle with respect to each other; that is they are not parallel with each other. Similarly in the stationary contact 112, the connection portion and the contact portion are arranged in an angle to each other, which tilting of the two is arranged inside the housing.

In the illustrated exemplary embodiment, the first stationary contact 110 is pivotally connected to the movable contact. The stationary contact remains stationary during the operation of the switch. The movable contact pivots between the two extreme positions shown in FIGS. 1 and 2. The pivotal connection between the first stationary contact 110 and the movable contact 130 is arranged inside the rotary actuator 120, that is, inside the perimeter of a cross section of the actuator. For example, the pivot axis of the pivotal connection coincides with the rotation axis of the rotary actuator 120.

In an exemplary embodiment, the connection portions of the stationary contacts 110, 112 are parallel and aligned with each other; that is, they are at the same plane. As the contact portions of the stationary contacts point substantially towards the rotation axis of the rotary actuator, the rotation axis of the actuator 120 lies below the plane of the connection portions of the stationary contacts 110, 112.

As the bold arrows indicate in FIG. 2, when the contact is closed, the exemplary current path forms substantially a letter V at the contact portion of the first stationary contact and the movable contact. For example, the V-form extends to the contact portion of the second stationary contact 112 such that the movable contact 130 and the contact portion of the second stationary 112 contact are substantially parallel with each other.

In the current path, the angle of the branches of the V is at its smallest when the movable contact barely touches the second stationary contact 112. At that point, the magnetic forces in the branches of V, that is, in the first stationary contact 110 and in the movable contact 130, oppose each other, and are at their greatest, causing the movable contact to turn away from the first stationary contact. Thereby the force alleviates the making of the contact of the movable contact and the second stationary contact. This phenomena can be especially advantageous in closing the switch against great short-circuit currents. If an exemplary nominal current of the switch is 4 kA, the short-circuit current may be as high as 80 kA, for instance. At such great currents, the V-profiled current path can greatly assist in closing the switch.

Thus, in the switch, the angle between the movable contact and the first stationary contact is greater when the switch is closed than the angle between the two when the switch is open. Here the angle between the two refers to the smaller angle, which is for example below 180 degrees if the contacts are assumed to originate from the pivot point between the two. For example, the angle between the two is less than 170 degrees when the switch is closed, and more preferably between 110 to 160 degrees in exemplary embodiments.

FIG. 2 shows also a receptacle 114 in the first stationary contact 110, and a receptacle 116 in the second stationary contact 112, which are used to fix the stationary contacts to the housing 102. The shown receptacles 114, 116 are to be set against a housing module that closes the housing module 102 shown in FIG. 2. There are similar receptacles in the stationary contacts 110, 112 on the opposite side of the stationary contacts to be set against the module 102.

Figure 3:
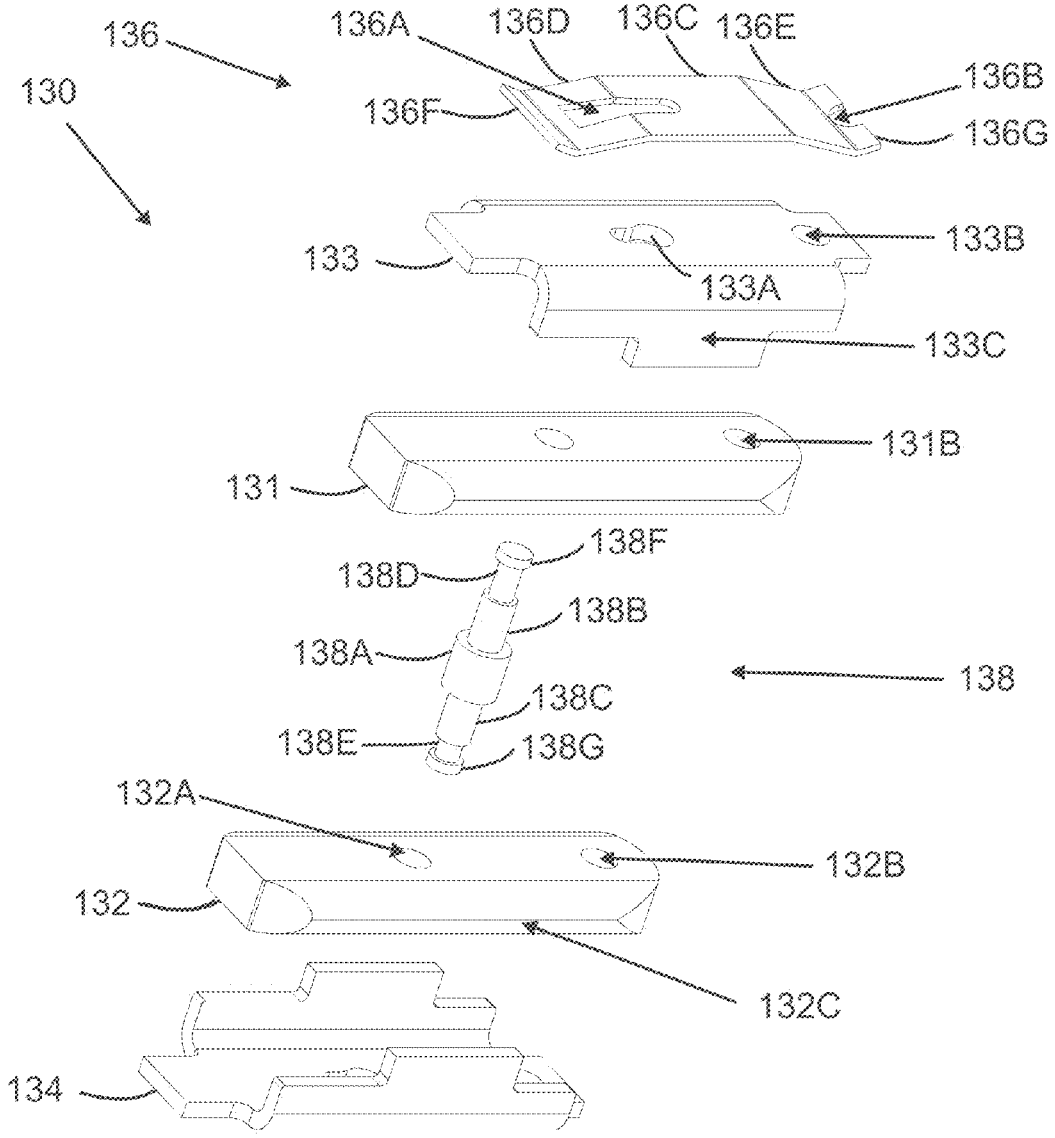
FIG. 3 shows an exemplary embodiment of a movable contact.

FIG. 3 shows an exploded view of an exemplary embodiment of a movable contact 130. The parts of the movable contact are a first contact blade 131, a second contact blade 132, an assembly pin 138, a first cover 133, a second cover 134, and a spring element 136.

The movable contact 130 makes an electrical connection with the stationary contact by receiving the stationary contact between the first and second contact blades 131, 132. The side 132C of the contact blade 132 that receives the stationary contact may be slanted to assist in receiving the stationary contact between the blades. The contact blade also comprises an assembly hole 132A for receiving the assembly pin 138 when the movable contact is assembled, and a pivoting hole 132B for receiving a pivoting pin when the movable contact is arranged together with stationary contact.

The movable contact may comprise first and second cover portions 133, 134, where the first cover portion 133 is placed next to the first contact blade 131, and the second cover portion 134 is placed next to the second contact blade 132. The contact blades 133, 134 may be similar to each other and when the movable contact is assembled, the cover portions 133 and 134 come mutually in opposite rotation position to each other.

The cover portion 133 comprises a side portion 133C covering and protecting the contact blade from the side. The cover portion 133 may be symmetric such that there is a similar side portion on the other side of the cover portion. On the top side, the cover portion may comprise an assembly hole 133A for receiving the assembly pin 138, and a pivoting hole 133B for receiving the pivoting pin.

The movable contact also comprises a spring element 136 on one side of the movable contact. Alternatively, another spring element may also be provided on the other side of the movable contact. The spring element can comprise an assembly hole 136A for receiving the assembly pin 138, and a receptacle 136B for receiving the pivoting pin. As can be seen, the assembly hole converges to the right; that is, the hole is at its greatest on the left in FIG. 3, and smallest to the right. The spring element can further comprise a top portion 136C, and two tilted portions 136D, 136E extending towards the first cover 133. At the ends of the spring element, there are provided projections 136F, 136G that are tilted such that they extend away from the first cover 133.

The assembly pin 138 can comprise a separation portion 138A, which defines the distance between the contact blades 131, 132. That is, the diameter of the separation portion 138A is greater than the diameter of the assembly hole 132A of the contact blade 132, whereby the contact blades set against the ends of the separation portion 138A.

The assembly pin 138 can further comprise a first contact blade portion 138B and a second contact blade portion 138C, which are to be placed into the assembly holes of the contact blades; that is, the diameter of the assembly hole 132A is greater than the diameter of the contact blade portion 138B, which in turn is greater than the assembly hole 133A of the cover. When assembled, the cover thus stops the contact blade portion 138B and sets against the end of it. In an exemplary embodiment, the thickness of the contact blade 131 is slightly greater than the length of the contact blade portion 138B. Thereby if the contact blade wears and becomes thinner, there is some clearance and the contact spring can still apply a pressing force for pressing the contact blade against the separation portion 138A of the pin 138.

As FIG. 3 shows, the assembly hole 133A can have a form of a keyhole having a first end with a greater diameter/aperture, and a second end with a smaller diameter/aperture. The assembly pin 138 can have a cover portion 138D and an end portion 138F having a greater diameter than the cover portion 138D. It can be seen that the cover portion 138D in one end of the assembly pin is longer than the cover portion 138E at the other end of the pin 138. The reason is that the cover portion 138D is as long as the assembly hole 133A and the assembly hole 136A of the spring 138 together. In the other end of the pin 138, it is sufficient that the length of the cover portion 138E equals to the thickness of the cover portion 134.

When the movable contact is assembled, the connection pin is put through the assembly holes in the contact blade 131, cover portion 133 and the contact spring 136A. The cover portion 138B is locked to the contact pin by moving the cover portion to the right, whereby the cover portion sets into the small end of the assembly hole 133B of the cover portion. The spring element 136 is locked to the contact pin by moving the contact pin to the left, whereby the cover portion of the pin enters the smaller end of the assembly hole 136A of the spring.

The contact blades may for example be made of the copper and be coated with silver, for instance. The cover portion, the spring element and the assembly pin may for example be made of steel to obtain more contact power due to magnetic forces.

The illustrated structure can provide an exemplary advantage in that the contact blades can be made straight, and there is no need for provision of projections on the surfaces of the contact blades to keep them separated.

Figure 4:
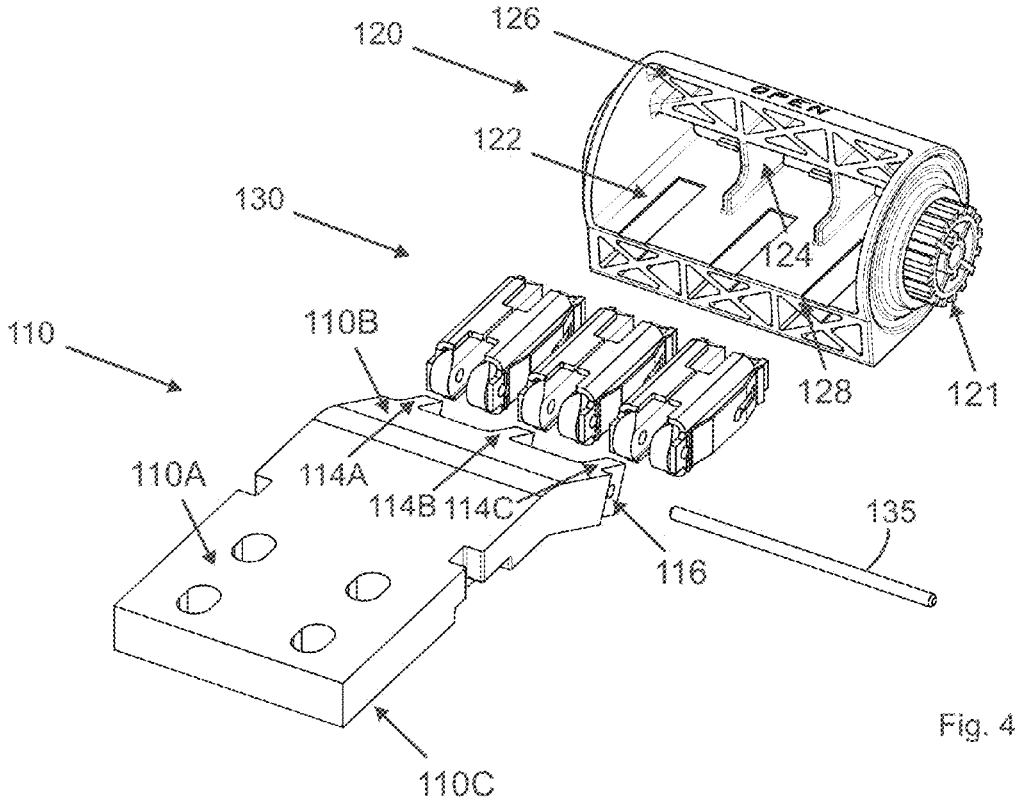
FIG. 4 shows an exemplary embodiment of a contact assembly.
Figure 5:
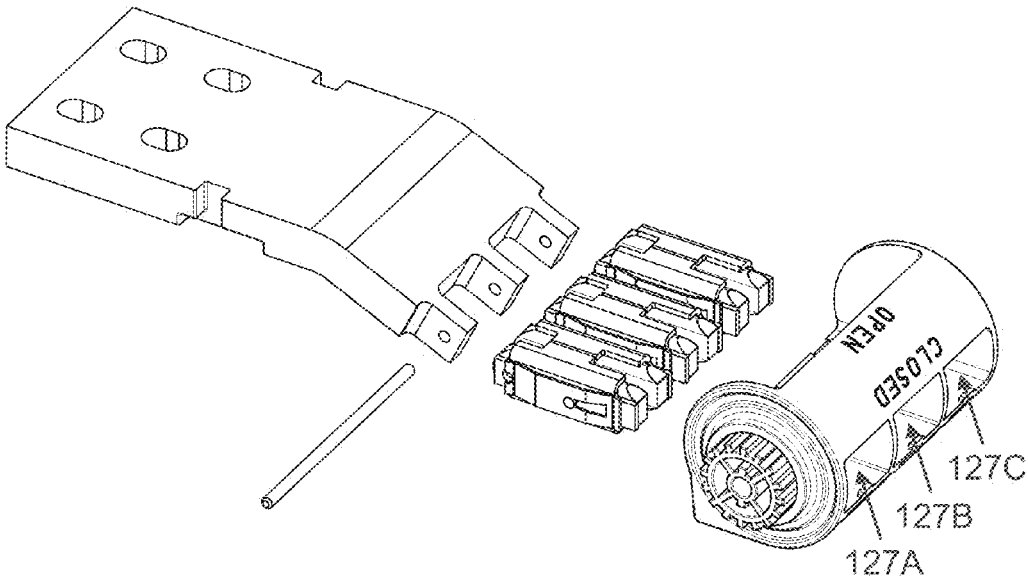
FIG. 5 shows another view of the exemplary contact assembly.

FIGS. 4 and 5 show an exemplary embodiment of a contact arrangement from two viewing directions. The contact arrangement comprises a stationary contact 110, a movable contact 130 and a rotary actuator 120.

When the stationary contact 110 and the movable contact 130 are assembled together, the movable contacts are set in the proximity of the projections 114A, 114B and 114C. Each of the projections is provided for mounting one of the shown three contact blade structures to the stationary contact. The contact blades of each contact blade structure are set to opposite sides of the respective projection such that the pivoting holes of the contact blade structures coincide with the pivoting holes 116 in the projections 114A, 114B and 114C. When the holes are aligned with each other, a pivoting pin 135 can be pushed through all the holes, whereby the contact blade structures become pivotally connected to the stationary contact 110.

Thereafter, the assembled structure of the stationary contact and the movable contact can be assembled to the rotary actuator 120. This is carried out pushing the assembled structure partly through the actuator. The actuator 120 comprises two apertures, one on each side of the actuator. In FIG. 4, there is provided a first aperture 122 on one side of the actuator, and in FIG. 5, there is provided a second aperture 127 on the opposite side of the actuator. In the exemplary embodiment of FIGS. 4 and 5, there are practically three second apertures 127A-127C corresponding to three contact blade assemblies. However, the embodiments are not restricted to exactly three contact blades and apertures, but rather the number of contact blades and apertures may vary from 1 to 5, for instance.

In the assembly of the stationary contact and the movable contact to the rotary actuator, the movable contacts are pushed in the actuator from the first aperture 122 such that each of the contact blade assemblies sets to their respective spaces separated by walls 124. The contact blades are pushed further such that their ends exit the actuator from the apertures 127A to 127C. At that stage, the projections of the stationary contact have entered the interior of the actuator. When the assembly is ready, the pivoting pin 135 sets inside the actuator, for example to the rotation axis of the actuator 120.

In an exemplary use, the stationary contact can be arranged stationary to the housing, but the rotary actuator may rotate within the housing. The rotation of the rotary actuator with respect to the stationary contact is defined by the upper wall 126 and the lower wall 128. In one extreme rotary position of the actuator 120, that is the open position, the top wall 126 of the actuator 120 sets against the top surface of the contact portion 1108 of the stationary contact 110. In the other extreme rotary position of the actuator, that is the closed position of the switch, the lower wall 128 of the aperture sets against the bottom surface 110C of the stationary contact 110. The edges of the aperture 122 thus define the rotary angle of the rotary actuator 120. On the other side of the rotary actuator, the second apertures 127A to 127C can be dimensioned such that the movable contacts, or the contact blade assemblies, are substantially fixed/immovable with respect to the rotary actuator 120, that there is tight fitting between the two. The movement of the movable contact(s) thus follows the rotation of the rotary actuator.

Figure 6:
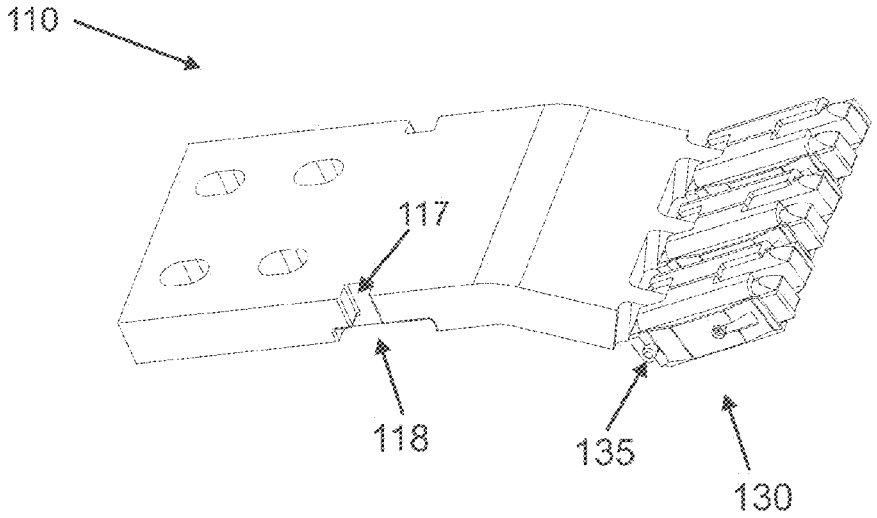
FIG. 6 shows another view of the exemplary contact assembly.
Figure 7:
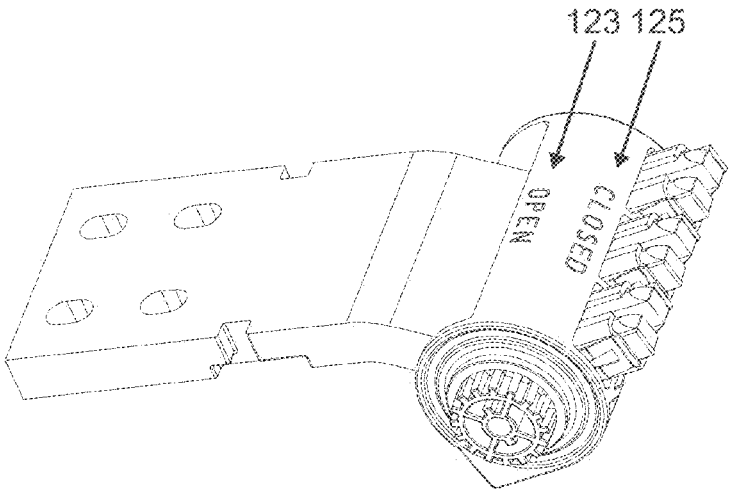
FIG. 7 shows another view of the exemplary contact assembly.

FIGS. 6 and 7 further highlight an exemplary contact arrangement. In FIG. 6, the movable contacts 130 have been assembled to the stationary contact 110. The movable contact of FIG. 6 comprises three contact blade arrangements. Each contact blade arrangement comprises two contact blades separates from each other to receive a stationary contact between the blades.

The assembly is completed by pushing the connection pin 135 through holes provides in the projections of the stationary contact, and the movable contacts. When the movable contacts are mounted to the stationary contact with the pin, the movable contacts are freely pivotable about the stationary contact. The amount of mutual pivoting of the movable contact and the stationary contact is, for example, limited by the rotary actuator shown in FIG. 7.

FIG. 6 also shows mounting recesses 117 and 118 in the stationary contact. A purpose of the mounting recesses is to mount the stationary contact to the switch module housing. There may be provided similar recesses on both sides of the stationary contact. The first mounting recess 117 is provided for keeping the stationary contact in place in horizontal direction. The second mounting recess is provided for fitting a thick stationary contact to a housing module which can receive also thinner stationary contacts. The second mounting recess 118 may extend the whole width, from one side to the other side of the stationary contact.

FIG. 7 shows two indications 123, 125 indicating the rotary position of the switch. The first indication 123 may indicate that the switch is in the open position, and the second indication 125 that the switch is in the closed position. The indications may comprise written words, such as "OPEN" and "CLOSED" or may include colour indications using green and red, for instance, or other desired indications.

The indications may, for example, be provided on a wall section of the actuator, which wall section is between the first and second apertures of the actuator. The indications may be provided on the wall by any known means, such as by writings, carvings, or by attaching a sticker, for instance. The indications, such as text, symbol or colour indications, are for example provided on the actuator perpendicularly to the rotation direction of the actuator.

Figure 8:
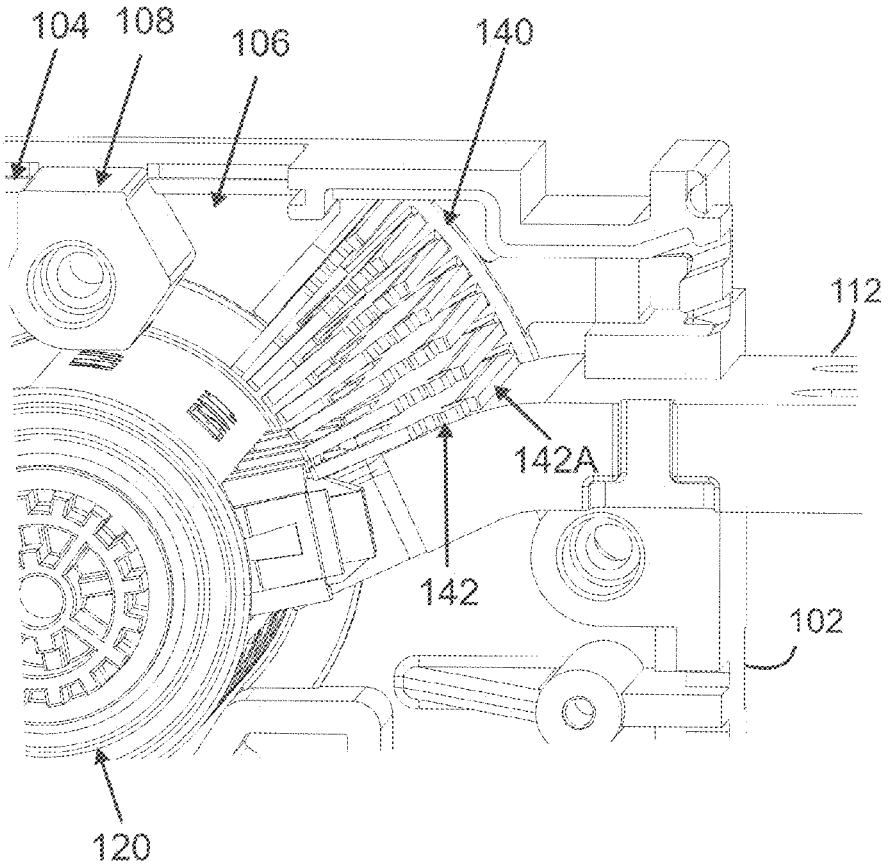
FIG. 8 shows an exemplary embodiment of a quenching plate assembly.

FIG. 8 shows an exemplary embodiment of a switch module housing 102 equipped with the components of the switch. The switch is shown in the closed position, where the movable contact is in contact with the second stationary contact 112. The housing comprises a second window 106, which shows the text CLOSED in this case. The housing also shows a support structure 108 to provide mechanical strength to the module when the housing halves are mounted together. In an exemplary embodiment, the support structure 108 comprises a receptacle for receiving a pin of a housing half that is to be mounted to the illustrated housing half 102.

The support structure is positioned inside the housing next to a wall of the housing and may be substantially aligned with the centre of the actuator in a longitudinal direction of the module. The support structure may be positioned between the windows 104, 106 such that the base of the support structure forms at least part of a housing wall residing between the windows. The windows may be implemented as apertures in the housing, to which housing a transparent plastic or glass window can be arranged.

During an exemplary use, the support structure 108 hides the text OPEN behind it such that it is substantially invisible from the first window when the switch is in the closed position. When the switch is rotated to the open position, the text OPEN emerges from behind the support structure 108 and is shown in the first window 104, which is closer to the first stationary contact 110 than the second window 106. When the switch is in the OPEN position, the text CLOSED is situated behind the support structure 108 and is substantially invisible from the second window 106.

In this way the security of the device can be greatly improved and combined when providing sufficient mechanical support for the module. The support section covers the indication that is not relevant at the particular moment, and the rotation of the rotary actuator is utilized in providing the indication.

FIG. 8 also shows a quenching chamber 140 of the housing, which houses one or more quenching plates for quenching an arc that fires when the movable contact is separated from the stationary contact 112. In the quenching chamber, the quenching plate 142 that lies closest to the stationary contact 112 touches the stationary contact. This can have an exemplary advantage that when the contacts are separated, the current is moved from the contact surface of the stationary contact to the point where the quenching plate touches the stationary contact. This can save the contact surface of the stationary contact 112 from the arc burning the contact.

In an exemplary embodiment, the quenching plate 142 and the other quenching plates are straight such that their two surfaces are direct plane surfaces. In another exemplary embodiment, the quenching plate(s), such as the first quenching plate 142, has a tilted portion 142A at the back of the plate. The tilted rear portion 142 is thus divergent from the general plane level of the plate. The first quenching plate 142 is mounted in such a way to the housing 102 that its protrusion 142A pointing towards the stationary contact 112 is in contact with the stationary contact.

The quenching plate 142 comprises a front portion located close to the contact area of the movable contact 130 and the stationary contact 112, and a rear portion that resides at a distance from the contact area, and the contact between the quenching plate 142 and the stationary contact is arranged at the rear portion of the quenching plate 142. The contact area between the two can be as small as possible to ensure catching the arc at the rear portion of the plate. The principal plane of the quenching plate and the stationary contact may be mutually slightly divergent such as to ensure that the contact area is small. In this way, the burning arc can be quickly moved away from the contact area. As FIG. 8 shows, this area of the rear portion 142A is an extreme point of the quenching plate 142 when seen from the contact area.

It can be seen that the stationary contact 112 comprises a contact portion to be contacted by the movable contact 130, and a connection portion to be contacted by a conductor, wherein the contact portion is divergent from the connection portion. The contact between the quenching plate 142 and the stationary contact 112 is arranged at the contact portion close to the area where the contact portion turns to the connection portion. In this way, the quenching plates can keep their position such that their plane surface points substantially towards the rotation axis of the rotary actuator, whereby the quenching plates can always be perpendicular to the movable contact 130 when it moves away from the stationary contact 112.

Figure 9:
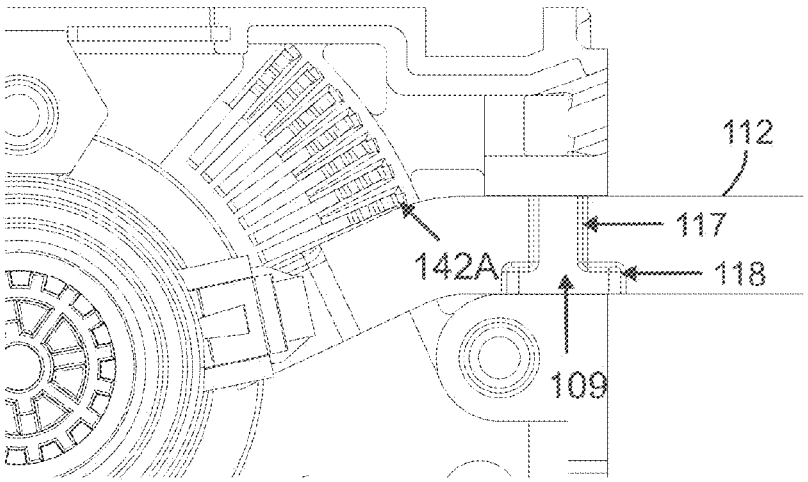
FIG. 9 shows another view of the exemplary quenching plate assembly.

FIG. 9 shows the tilting of the quenching plate 142A from another viewing angle. The tilting may extend substantially the whole width of the stationary contact and the quenching plate.

FIG. 9 highlights also a mounting of the stationary contact to the module housing. The illustrated exemplary embodiment can be especially advantageous, as the housing is capable of receiving stationary contacts of different thicknesses. The manufacturing of a mould for the module housing can be very expensive and it can therefore be advantageous that the same housing module can be used for switches having different nominal currents.

The exemplary embodiment achieves this by having a projection 109 at an aperture of the housing where the stationary contact 112 is to be mounted. FIG. 9 shows a thick stationary contact where the stationary contact comprises a recess 118 for receiving the projection 109. When the stationary contact is mounted to the housing, the projection 109 in the housing fills the recess 118 in the stationary contact.

If assumed that the switch to be equipped would have a smaller nominal current, the stationary contact could be made thinner. In such as case, the stationary contact can be without a recess 118 as the shown stationary contact. The stationary contact would then lie on the projection 109.

The housing may comprise another projection, which fills the recess 117 in the stationary contact. This joint can prevent the stationary contact from moving in a longitudinal direction of the stationary contact; that is, to the left and right in the shown embodiment. Such a recess 117 may be provided both in the thick and thin stationary contacts.

Figure 10:
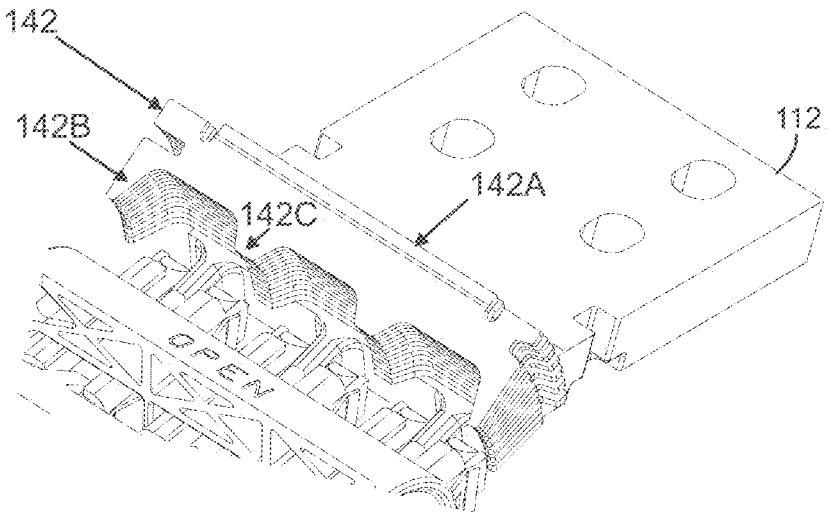
FIG. 10 shows another view of the exemplary quenching plate assembly.

FIG. 10 further highlights an exemplary structure of the quenching plates and co-operation between the quenching plates and the movable contacts. In FIG. 10, the illustrated quenching plate is the furthermost quenching plate from the stationary contact, but the quenching plate closest to the stationary contact may be assumed to be a similar plate. The plate may otherwise be planar, but it comprises a bent portion 142A, which points towards the stationary contact such that the quenching plate closest to the stationary contact touches the stationary contact when mounted to the switch. The quenching plate 142 may further comprise one or more projections 142B, 142C, which project towards the movable contacts. It may be arranged such that each contact blade assembly fits between a pair of projections whereby the projections are between the contact blade assemblies when the movable contact moves. The exemplary projections and the base there between form substantially a letter U. The projections can provide an exemplary advantage in that the arc is immediately caught away from burning with the movable contact. The quenching plate shown in FIG. 10 has thus an advantage that it efficiently protects the stationary contact by catching the arc to the projection 142A, and it protects the movable contact by catching the other end of the arc to the projections 142B or 142C.

Figure 11:
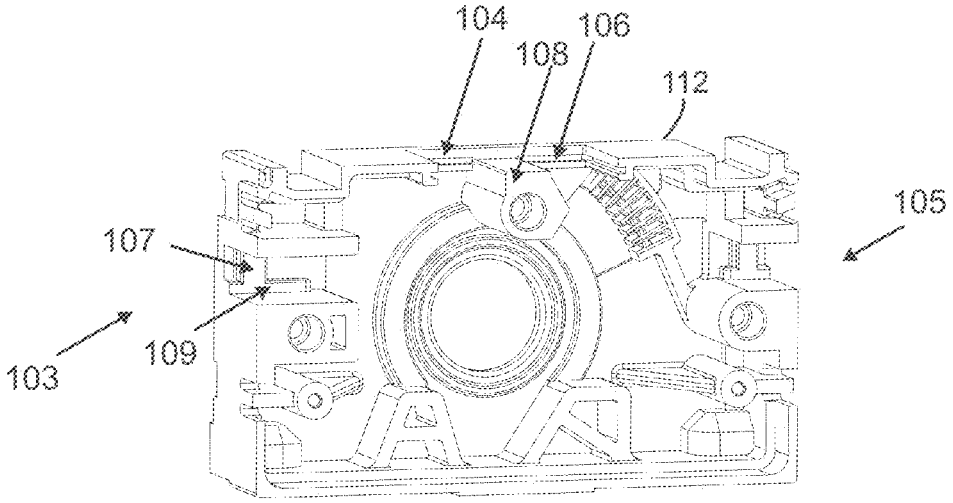
FIG. 11 shows an exemplary embodiment of a module housing.

FIG. 11 shows an exemplary embodiment of a module housing half 102. The housing comprises various projections and recesses for connecting to matching elements in the other housing half, thereby ensuring a mechanical strength of a module when the housing halves are mounted together. In the case of alternating current where the current direction can change often, such as at high short circuit currents, the forces that shake and attempt to separate the modules/poles can be very strong. It can thus be desirable to have elements that provide the mechanical strength evenly distributed over the area of the housing.

In the exemplary situation of FIG. 11, this has been achieved by providing a support element, such as a receptacle 108 at top of the housing above the recess for the actuator. In the illustrated embodiment, this support element can be advantageously utilized by providing two windows 104, 106 on both sides of the support element 108. These windows are co-operatively coupled to the operation of the rotary actuator. The rotary actuator can have an indication such as a printed, carved, or other indication on its surface with respect to the open and closed positions of the switch. The indications are visible from either of the windows 104, 106 to the user of the device. This can provide a great security advantage as a user can immediately ensure whether the switch is in a connected state or not. A direct indication of the rotation position of the roll can be advantageous as compared to the indication of the rotation position of the rotation mechanism, as the mechanism may give a faulty indication if some internal switch mechanism element is broken.

By way of an example, if the rotary mechanism of a switch breaks, a rotary actuator may not rotate even if the rotation mechanism is rotated. It may then occur that the switch is closed even if the rotation mechanism indicates that the switch would be open. The illustrated solution can avoid this, as the actual rotation position of the rotary actuator can always be verified.

FIG. 11 also highlights an exemplary implementation of the apertures in the housing that receive the stationary contacts. There is a first aperture 103 at one end of the module, and a second aperture 105 at the opposite end of the substantially rectangular housing. The apertures are, for example, at the same heights in the module. The dimensions of the apertures may, however be slightly different from each other.

The opening for housing the actuator may be placed substantially in the middle of the module in the left-right direction in FIG. 11. As the movable contact and the quenching chamber involve some space, there is less space for the stationary contact on the right. The second stationary contact may be shorter than the first stationary contact and some space may also be saved in that the aperture 105 receiving the second stationary contact is shorter than the aperture 103 receiving the first stationary contact.

The aperture can comprise a first projection 109 which allows mounting of stationary contacts of two different thicknesses to the aperture. Despite the different thicknesses, the stationary contacts have the same width. The width of the stationary contacts is substantially double the width of the aperture 103 shown as half of the stationary contact sets into the aperture 103 and the other half to the other module housing to be assembled to the shown housing.

It can be seen that the projection is placed, in the embodiment of FIG. 11, parallel to the longitudinal direction of the stationary contact. The projection is arranged such that it extends from the bottom wall of the aperture. For example, the projection residing at the edge of the aperture fills only a small part of the width of the bottom wall. The height of the projection corresponds to the thickness difference of the two stationary contacts.

In a thicker stationary contact, there is a recess corresponding to and receiving the projection 109, whereby the rest of the stationary contact sets against the bottom surface of the recess 103. The thinner stationary contact has no such recess, whereby the bottom of the thinner stationary contact sets against the top surface of the projection 109.

Both the thin and thick stationary contacts may comprise a vertical recess for receiving the projection 107. The exemplary vertical and horizontal projections 107, 109 form substantially a letter T. They may extend equally long away from the side wall surface of the aperture.

Figure 12:
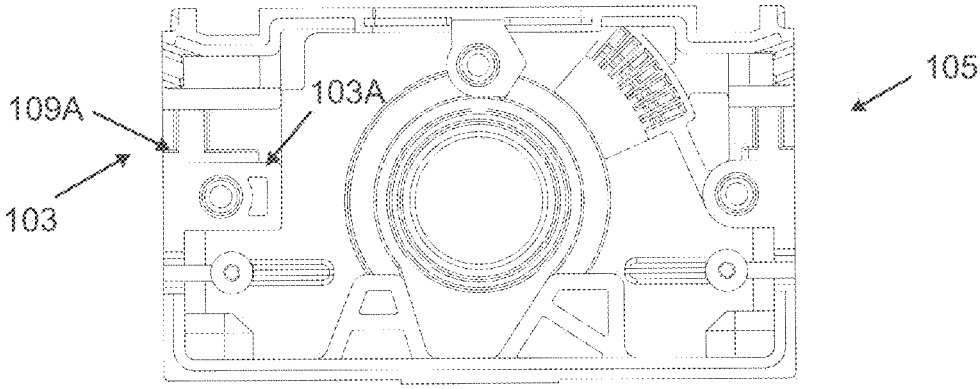
FIG. 12 shows another view of the exemplary module housing.

FIG. 12 shows another view of already discussed features. It can be seen that the middle of the aperture receiving the actuator lies lower than the apertures 103, 105 of the housing receiving the stationary contacts. This can provide an exemplary advantage in that the current path becomes a letter V at the position where the movable contact is to contact the stationary contact thereby alleviating the making of the connection.

There is also another exemplary advantage. In a switch having a high nominal current, there may be a desire to connect the stationary contact outside the switch module to one or more additional current conducting rails, which may have thicknesses equal to the thickness of the stationary contact. The holes provided in the stationary contact shown in FIGS. 6 and 7 may be used for that purpose. Even in such a situation it may be desirable to ensure that the current conductors lie at a predetermined distance from the bottom of the housing in the viewing angle of FIG. 12. Due to this, the positioning of the apertures higher than the middle line of the housing module provides an exemplary additional advantage that there is enough space available below the stationary contacts. This can be seen from FIG. 13, where the stationary contacts 110, 112 exit the housing such that the top level of the stationary contact is substantially at the same level as the top edge of the rotary actuator 120.

FIG. 12 shows how the first projection 109 extends from the bottom surface 103A and a side surface of the aperture. The term bottom refers to the surface of the aperture that is lowest in the usage position of the switch as shown in FIG. 12. Alternatively, the projection could for example extend from the top surface of the aperture downwards.

FIG. 12 shows also the top surface 109A of the first projection. The lower surface of the thinner stationary contact sets against the top surface of the projection. Also the bottom side of a recess of the thicker stationary contact sets against the top side of the projection 109A.

Figure 13:
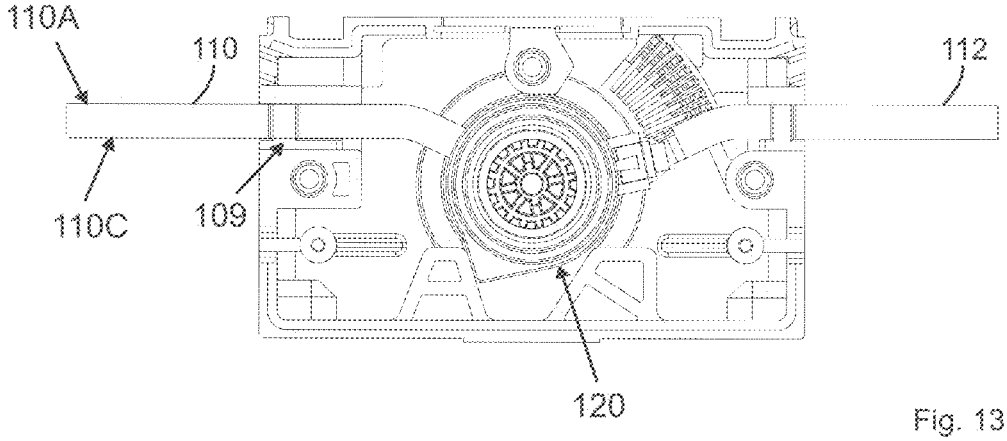
FIG. 13 shows another view of the exemplary module housing.

FIG. 13 shows a situation, where a thinner stationary contact for a smaller nominal current, such as 3150 A, is introduced into the switch module having a principal nominal current of 4000 A. It can be seen that the lower surface 110C of the stationary contact 110 lies over the horizontal projection 109 in the aperture 103.

It can be especially advantageous to arrange the horizontal projections 109 such that they are on the side of the aperture 103 that is closer to the middle line of the switch housing. In FIG. 13, this side is the bottom side of the aperture. In this way, the stationary contact may be arranged as high as possible in the situation of FIG. 13.

In the FIG. 13 exemplary embodiment, the projection can reside only at the edges of the aperture, whereby there is an open space under the thinner stationary contact 110, 112 between the illustrated projection 109 and a corresponding aperture in the housing module that is to be mounted to the illustrated module. This aperture has an exemplary advantage that it provides additional cooling for the thinner stationary contact.

Figure 17:
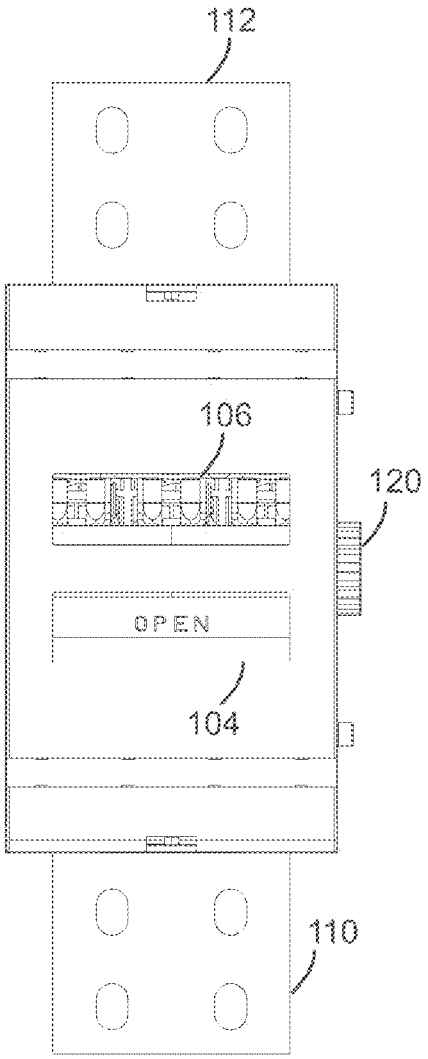
FIG. 17 shows an exemplary display arrangement of a contact module.
Figure 18:
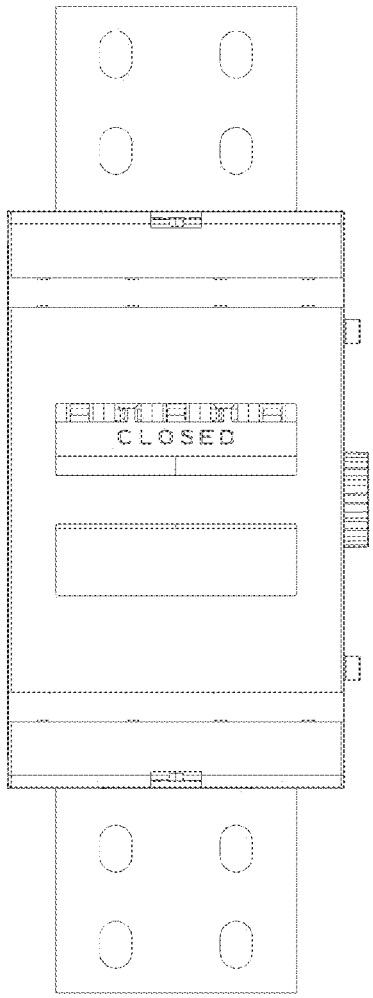
FIG. 18 shows another view of an exemplary display arrangement of a contact module.

FIG. 13 shows that there are recesses in both windows 104, 106 for receiving a transparent window element therein. The window element may be a plastic or glass window element. For example, the mounting of the window element is arranged such that one window element can cover both windows. The housing may comprise a groove, which houses the window element between the windows 104, 106 such that the window element is not visible to the outside as shown in FIGS. 17 and 18.

This solution provides an exemplary advantage that mounting of the window element is simple as there is need only for one window element. Furthermore, the mounting of the window element is mechanically very strong, as the window element is mechanically supported at the middle of the window.

Figure 14:
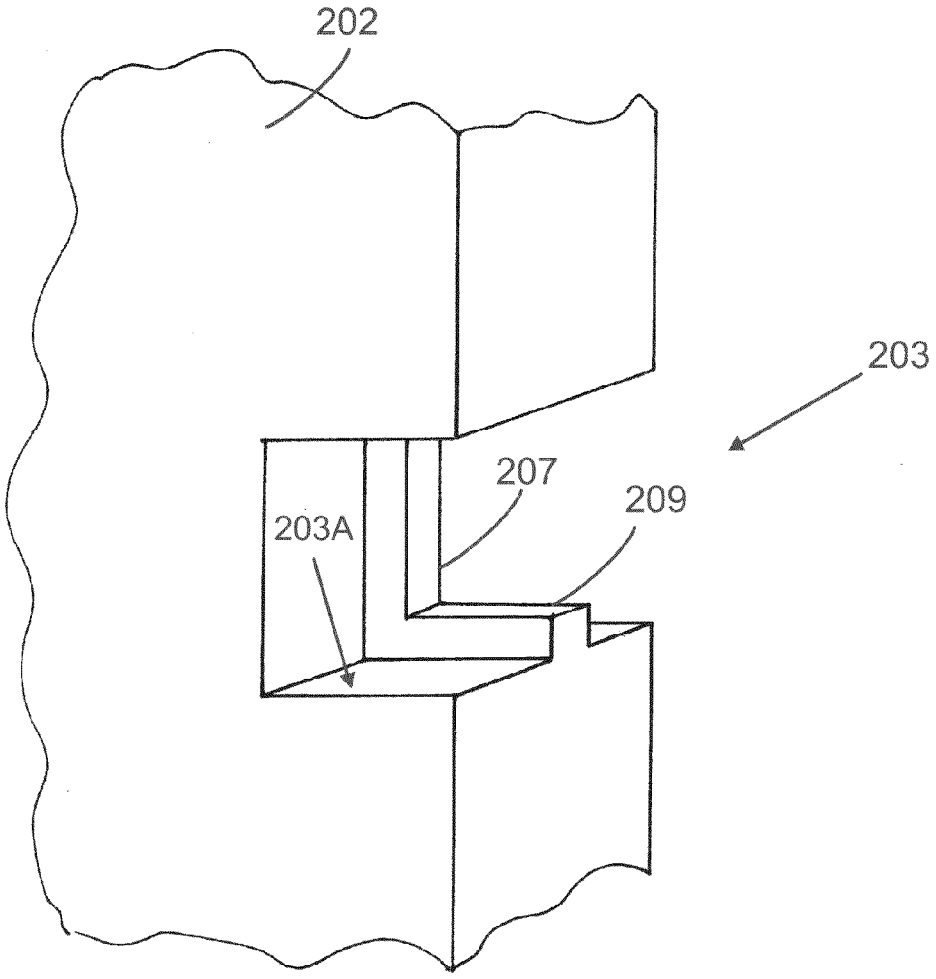
FIG. 14 shows an exemplary embodiment of a stationary contact assembly arrangement.
Figure 15:
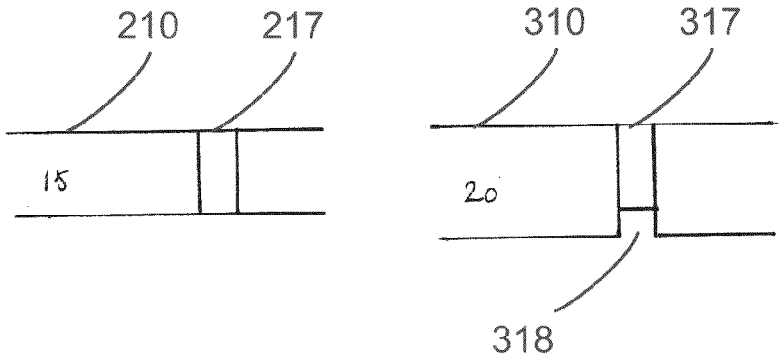
FIG. 15 shows an exemplary embodiment of two different stationary contacts.

FIGS. 14 and 15 highlight another exemplary embodiment for mounting of the stationary contacts to the housing. FIG. 14 shows a housing 202, which comprises an aperture 203 for receiving a stationary contact. To the aperture, there is formed a first projection 209, which projects from the bottom of the aperture. Similarly as in previously illustrated embodiments, such as FIG. 13, the projection is formed integrally and non-detachably to the housing. For example, the projection is formed to the housing by injection moulding as in the embodiment of FIG. 12. Instead of a single projection 209 as shown in FIG. 14, the housing may also comprise two or more projections, such as studs, having spaces between the projections.

The projection 209 is formed within the interior of the aperture. The interior of the aperture refers here to the space at the aperture which is between the inner and outer walls of the housing. Similarly, a recess of the stationary contact that receives the projection is provided such that the recess resides within the interior of the aperture when the stationary contact is mounted to the housing.

The embodiment of FIG. 14 differs from the embodiment of FIG. 13 in that the projection extends transversely to the longitudinal direction of the stationary contact when mounted to the aperture. The projection extends thus along the width of the stationary contact. This has the effect that even in the case of a thinner stationary contact, the housing stays closed and there remains no void space under the thinner stationary contact when mounted to the aperture.

FIG. 14 shows also a second projection 207 which may be provided for locking the stationary contact in longitudinal direction to the housing. The locking member 207 is, for example, arranged transversely/perpendicularly to the first projection 209.

FIG. 15 highlights two different stationary contacts 210, 310. The thinner stationary contact is for example 15 mm thick, and the thicker stationary contact 310 is for example 20 mm thick. In the illustrated embodiment, both of the stationary contacts have a second recess 217, 317 for receiving the locking member 207 of the housing.

The thicker stationary contact 310 can have an additional first recess 318 for receiving the first projection 209 of the housing.

Thus, both stationary contacts of FIG. 15 can be mounted to the housing 202 of FIG. 14. The thinner stationary contact 210 sets against and above the first projection 209, whereas the first recess 318 of the thicker stationary contact 310 sets against the projection 209. The rest of the thicker stationary contact 310 thus sets against the bottom surface 203A of the recess 203.

Figure 16:
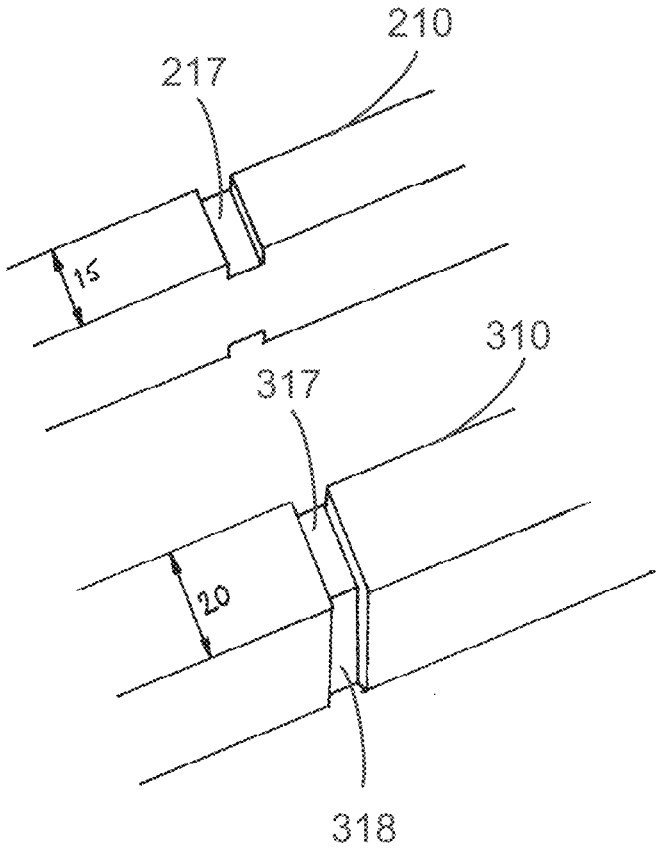
FIG. 16 shows another view of two different exemplary stationary contacts.

FIG. 16 shows the two different stationary contacts from another viewing angle. It can be seen that the stationary contact 210 for a smaller nominal current has a recess 217 only for the locking member of the housing. The stationary contact 310 for the higher nominal current has a recess 317 for the locking member and a recess 318 for the compensating means, that is, for the first projection 209. The two recesses in the stationary contact 310 are on different sides of the contact.

It is noted that both stationary contacts have the same width, which in FIG. 16 is the direction of the recess 318.

In a further embodiment, stationary contacts may be mounted to the switch housing by providing compensation means on the stationary contact instead of the housing. In this embodiment, the housing comprises an aperture, which is sized for receiving, by a substantially tight fitting, the thicker stationary contact of the two stationary contacts. The thinner stationary contact may comprise one or more projections, whose length corresponds to the thickness difference of the two stationary contacts, that is may be 5 mm, for instance.

In a further embodiment, the aperture comprises recesses, and both the stationary contacts comprise projections. The difference between the length of the projections correspond to the thickness difference of the stationary contacts.

FIGS. 17 and 18 highlight an exemplary implementation of the switch status indication. There are provided two windows 104, 106 at the outer surface of the housing. The actuator 120 projects out from the housing on the right hand side. When the rotary actuator 120 is turned clockwise, the movable contact rotates towards the closed position, and turning the actuator switches the switch to the open position. The open position is shown in FIG. 17, and the closed position in FIG. 18.

The indications CLOSED/OPEN can be provided on the actuator. The "open" indication is in the actuator closer to the first stationary contact 110, whereby this indication is shown in the first window 104. The "closed" indication is closer to the second stationary contact 112, whereby this indication is shown in the second window 106.

It will be apparent to a person skilled in the art that, as the technology advances, the inventive concepts disclosed herein can be implemented in various ways. The invention and its embodiments are not limited to the examples described above but may vary within the scope of the claims.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. A rotary switch module, comprising:

a first stationary contact;

a second stationary contact;

a movable contact for making an electrical connection between the first stationary contact and the second stationary contact;

a rotary actuator for rotating the movable contact, wherein the rotary actuator includes on a surface a first indication indicating an open position of the first and second stationary contacts, and a second indication indicating a closed position of the first and second stationary contacts;

a first window indicating the first indication; and a second window separate from the first window indicating the second indication, wherein the movable contact is pivotally connected to the first stationary contact, and the first window is closer to the first stationary contact than the second window.

2. A rotary switch module according to claim 1, wherein the first and second indications are arranged on the rotary actuator perpendicularly to a rotation direction of the rotary actuator.

3. A rotary switch module according to claim 1, wherein the movable contact is fixedly arranged to the rotary actuator, and the second indication is arranged on the actuator close to the movable contact, and the first indication is arranged on the rotary actuator further away from the movable contact than the second indication.

4. A rotary switch module according to claim 1, comprising:

a module housing having a substantially rectangular form, wherein the first stationary contact and/or the second stationary contact includes a connection portion arranged substantially perpendicularly to a wall of the module housing; and a contact portion connected to the movable contact, the contact portion being arranged to an angle with respect to the connection portion.

5. A rotary switch module according to claim 4, wherein the connection portions of the first and second stationary contacts exit the module housing from opposite ends of the module housing, and connection portions of the stationary contacts are arranged at a same plane to each other, and a rotation axis of the rotary actuator is arranged away from the plane of the connection portions of the stationary contacts.

6. A rotary switch module according to claim 4, wherein the first and second windows are provided as apertures in the module housing, to which apertures transparent windows are mounted.

7. A rotary switch module according to claim 1, wherein the first and second indications are provided on the actuator as a print, a carving or a sticker.

8. A rotary switch module according to claim 1, wherein the first and second indications are provided on the actuator as text, a symbol or a color.

9. A rotary switch module according to claim 1, comprising:

a first aperture for receiving at least one of the first and second stationary contacts, the first aperture having a top wall and a bottom wall, which limit movement of the movable contact with respect to the at least one stationary contact; and a second aperture for receiving the movable contact, the second aperture having a top wall and a bottom wall which substantially prevent movement of the movable contact with respect to the rotary actuator such that the movable contact follows rotation of the rotary actuator, wherein the first aperture and the second aperture are arranged in the rotary actuator such that there is an angle between the movable contact and the at least one stationary contact in all rotary positions of the rotary actuator.

10. A rotary switch module, comprising:

a first stationary contact;

a second stationary contact;

a movable contact for making an electrical connection between the first stationary contact and the second stationary contact;

a rotary actuator for rotating the movable contact, wherein the rotary actuator includes on a surface a first indication indicating an open position of the first and second stationary contacts, and a second indication indicating a closed position of the first and second stationary contacts;

a first window indicating the first indication;

a second window separate from the first window indicating the second indication; and a support structure inside a module housing for providing mechanical strength for the rotary switch module, the support structure being arranged between the first window and the second window.

11. A rotary switch module according to claim 10, wherein the module housing comprises:

a wall section between the first window and the second window.

12. A rotary switch module according to claim 10, configured such that when the first indication is shown in the first window, the second indication is arranged behind the support structure and is substantially invisible from the second window, and when the second indication is shown in the second window, the first indication is behind the support structure and substantially invisible from the first window.

13. A rotary switch module according to claim 10, wherein the first and second indications are arranged on the rotary actuator perpendicularly to a rotation direction of the rotary actuator.

14. A rotary switch module according to claim 10, wherein the movable contact is fixedly arranged to the rotary actuator, and the second indication is arranged on the actuator close to the movable contact, and the first indication is arranged on the rotary actuator further away from the movable contact than the second indication.

15. A rotary switch module, comprising:

a first stationary contact;

a second stationary contact;

a movable contact for making an electrical connection between the first stationary contact and the second stationary contact;

a rotary actuator for rotating the movable contact, wherein the rotary actuator includes on a surface a first indication indicating an open position of the first and second stationary contacts, and a second indication indicating a closed position of the first and second stationary contacts;

a first window indicating the first indication; and a second window separate from the first window indicating the second indication, wherein the movable contact and the first stationary contact are arranged in a first angle with respect to each other in the open position of the first and second stationary contacts, and in a second angle with respect to each other in the closed position of the first and second stationary contacts, and the second angle is greater than the first angle, the second angle being less than 180 degrees.

16. A rotary switch module according to claim 15, comprising:

a module housing having a substantially rectangular form, wherein the first stationary contact and/or the second stationary contact includes a connection portion arranged substantially perpendicularly to a wall of the module housing; and a contact portion connected to the movable contact, the contact portion being arranged to an angle with respect to the connection portion.

17. A rotary switch module according to claim 16, wherein the connection portions of the first and second stationary contacts exit the module housing from opposite ends of the module housing, and connection portions of the stationary contacts are arranged at a same plane to each other, and a rotation axis of the rotary actuator is arranged away from the plane of the connection portions of the stationary contacts.

18. A rotary switch module according to claim 16, wherein the first and second windows are provided as apertures in the module housing, to which apertures transparent windows are mounted.

19. A rotary switch module according to claim 15, comprising:

a first aperture for receiving at least one of the first and second stationary contacts, the first aperture having a top wall and a bottom wall, which limit movement of the movable contact with respect to the at least one stationary contact; and a second aperture for receiving the movable contact, the second aperture having a top wall and a bottom wall which substantially prevent movement of the movable contact with respect to the rotary actuator such that the movable contact follows rotation of the rotary actuator, wherein the first aperture and the second aperture are arranged in the rotary actuator such that there is an angle between the movable contact and the at least one stationary contact in all rotary positions of the rotary actuator.

20. A rotary switch module according to claim 15, wherein the first and second indications are provided on the actuator as at least one of a print, a carving, a sticker, text, a symbol and a color.

* * * * *